US006601718B2

(12) United States Patent
Sawodny et al.

(10) Patent No.: US 6,601,718 B2
(45) Date of Patent: Aug. 5, 2003

(54) PROCESS FOR THE ORIENTATION OF THE LOAD IN CRANES

(75) Inventors: Oliver Sawodny, Ulrichstrasse 36, D-89278 Nersingen (DE); Stefan Lahres, Aalen (DE); Harald Aschemann, Amstetten (DE); Ebberhard Paul Hofer, Lonsee (DE)

(73) Assignees: Oliver Sawodny, Nersingen (DE); Eberhard Paul Hofer, Lonse (DE)

( * ) Notice: Subject to any disclaimer, the term of this patent is extended or adjusted under 35 U.S.C. 154(b) by 0 days.

(21) Appl. No.: 09/882,913

(22) Filed: Jun. 15, 2001

(65) Prior Publication Data

US 2002/0149217 A1 Oct. 17, 2002

(30) Foreign Application Priority Data

Jun. 15, 2000 (DE) ..... 100 29 579

(51) Int. Cl.[7] ..... B66C 13/02
(52) U.S. Cl. ..... 212/270; 212/273; 294/81.4
(58) Field of Search ..... 212/272, 273, 212/270; 294/81.3, 81.4

(56) References Cited

FOREIGN PATENT DOCUMENTS

| | | |
|---|---|---|
| DE | 2022745 | 11/1971 |
| DE | 3210450 | 10/1983 |
| DE | 3228302 | 2/1984 |
| DE | 3710492 | 10/1988 |
| DE | 3933527 | 4/1991 |
| DE | 69119913 | 10/1994 |
| DE | 1278079 | 9/1998 |
| DE | 19920431 | 11/2000 |

*Primary Examiner*—Thomas J. Brahan
(74) *Attorney, Agent, or Firm*—Dilworth & Barrese LLP.

(57) ABSTRACT

The invention concerns a process for the orientation of the load in cranes, in which the load hung from cables is rotated by a predetermined absolute angle using rotating gear between cable and load. Under the invention, here a regulating device is provided for the rotating gear with which torsion oscillations of the load are suppressed, where, as input values, the absolute rotating angular speed and the angular position of the rotating gear are measured and fed back to the setting input.

20 Claims, 8 Drawing Sheets

PROCESS FOR THE ORIENTATION OF THE LOAD IN CRANES

BACKGROUND OF THE INVENTION

The invention concerns a process for orienting the load in cranes in which the load supported by cables is turned by a specified absolute angle using rotating gear between cable and load.

In order to assure efficient material flow, most cranes are equipped with a special load-lifting member on the lower block of the load cable depending upon the goods that are to be transported. For example, a container spreader serves as a load-lifting member for containers. When an asymmetrical object is to be transported, orientation of the load at the destination point is necessary. Orientation means that the load at the destination point is rotated by a specified angle. For this purpose, a rotating gear is built into the load-lifting member, between the cable hanging point and the gripping device for the load.

If such rotating gear is actuated, then a too rapid rotation of the load will result in rotary oscillation, which an experienced crane operator can damp with a proper counter-move of the rotating gear. However, how rapidly he can compensate for such torsional oscillation depends upon the experience and the skill of each crane operator. For example, in the case of corresponding wind loading, a corresponding torsional oscillation may be induced from outside. These overlaid torsion oscillations are very difficult for the crane operator to compensate for.

Already known are processes for the suppression of swinging oscillation in cranes.

Thus, DE 127 80 79 describes a device for the automatic suppression of the swinging of a hanging load by means of a cable that is attached to a cable attachment point that is movable in the horizontal plane, by moving the cable attachment point in at least one horizontal coordinate in which the speed of the cable attachment point in the horizontal plane is controlled by a regulating circuit, depending on a value derived from the deflection angle of the load cable against the final vertical line.

DE 20 22 745 shows an arrangement for the suppression of swinging oscillations of a load that is hung on the cat of a crane by means of a cable, whose drive is equipped with a rotating device and a travel regulating device, with a regulating device that, taking into account the oscillation period, accelerates the cat during a first part of the path traveled by the cat and, during the last part of this path, delays it in such a way that the movement of the cat and the oscillation of the load at the destination point become equal to zero.

From DE 321 04 50, a device on lifting equipment was made known for the automatic control of the movement of the load-bearing member, with a slowing of the swinging that occurs on acceleration or braking of the load hanging from it, during an acceleration and/or braking interval. The basic idea is based on simple mathematical swinging. The cat and load mass is not included for calculating the movement. Coulomb and friction of the cat or bridge drives proportional to speed are not considered.

In order to transport a load body as rapidly as possible from its location to its destination, DE 322 83 02 suggests that the rotational speed of the drive motor of the running cat be controlled by a computer in such a manner that the running cat and the load carrier are operated at the same speed steady-state travel and the damping of swing is achieved in the shortest time. The computer known from DE 322 83 02 works on a computer program to solve the differential equations that apply to the undamped two-mass oscillation system formed by the running cat and the load body, where the coulomb and speed-proportional friction of the cat or bridge drive are not considered.

In the process that became known from DE 37 10 492, the speed between the destinations on the way is chosen in such a manner that after passing through half the total path between starting point and destination, the effective swing is always equal to zero.

The process that became known from DE 39 33 527 for damping of load swing oscillations includes a normal speed-position regulation.

DE 691 19 913 discusses a process to control the setting of a swing load in which, in a first regulating circuit, the difference between the theoretical and the actual position othe load is portrayed. This is derived, multiplied by a correction factor, and added to the theoretical position of the movable carrier. In a second regulating circuit, the theoretical position of the movable carrier is compared with the actual position, multiplied by a constant, and added to the theoretical speed of the movable carrier.

DE 44 02 563 covers a process for the regulation of electrical drives for lifting equipment with a load hanging from a cable, which generates the desired progress of the speed of the crane cat on the basis of the equations describing the dynamics, and feeds it to a speed and current regulator. Furthermore, the computer device can be expanded by a position regulator for the load.

The regulating processes that became known from DE 127 80 79, DE 393 35 27 and DE 691 19 913 need the cable angle sensor for load swing damping. In the expanded embodiment according to DE 44 02 563, this sensor is also necessary. Since the cable angle sensor causes substantial costs, it is advantageous if the load swing can be compensated for even without this sensor.

The process of DE 44 02 563 in the basic version also requires at least the cat speed. Also, in DE 20 22 745, multiple sensors are necessary for load-swing damping. Thus, in DE 20 22 745, at least an RPM and position measurement of the crane cat must be done.

Also, DE 37 10 492 needs at least the cat or bridge position as an additional sensor.

As an alternative to this process, another approach suggests, as became known, for example, from DE 32 10 450 and DE 322 83 02, solving the differential equations on which the system is based and, on this basis, determining a strategy for the system in order to suppress load swings where, in the case of DE 32 10 450, the cable length, and in the case of DE 322 83 02, the cable length and load mass, are measured. In these systems, however, the friction effects of static friction that are negligible in the crane system and friction proportional to speed are not taken into account. Even DE 44 02 563 does not consider friction and damping terms.

In the previously unpublished DE 199 20 431, by the Applicants of this invention, a process was achieved for load swing damping on cranes, with a control algorithm that is based on the fundamental idea that not only the function of the desired load position as a function of time is to be generated as a control value, but also the function for the desired load speed, desired load acceleration, desired load jerk and the derivation of the desired load jerk, and, in a pre-control block, fed to the crane system weighted in such a manner that the resulting overall system of crane dynamics and pre-control is correct as to speed, acceleration, jerk and the derivation of the jerk. As minimum input values for this older priority, but not published, process, the cable length and the load mass are needed.

None of the previously known processes addresses the set of problems of torsion oscillations upon actuation of the rotating gear, mentioned at the beginning.

SUMMARY OF THE INVENTION

The problem to be solved by this invention is, therefore, to create a process for orienting the load on cranes in which the load supported by cables is turned a specified absolute angle using rotating angle using rotating gears with which a load can be turned to a defined angular position without giving rise to torsion oscillations and with which, possibly, externally caused torsion oscillations can be effectively damped.

According to the invention, the problem is solved using a process with the combination of a regulation for the rotating gear suppressing torsional oscillations of the load, where, as input values, the absolute rotational angular speed and the angular position of the rotating gear are measured and fed back to the setting input. Here, a regulation of the rotational gear is achieved, which is based on the measurement of the absolute rotational angle speed and the angle position of the rotational axis of the rotating gear.

Further details and advantages of the invention are shown herein.

According to the invention, the problem is solved using a process with the combination of characteristics of claim 1. Here, a regulation of the rotational gear is achieved, which is based on the measurement of the absolute rotational angle speed and the angle position of the rotational axis of the rotating gear.

Further details and advantages of the invention are shown in the subclaims following the main claim.

According to this, the rotational movement of the load and the gripping device for the load can be detected with a gyroscopic sensor. Since the measuring signal in available gyroscopic sensors is in part very noisy and made inaccurate through drift and offset, according to a further advantageous embodiment of the invention, the offset is estimated in such a so-called interference monitoring module and compensated for. An observer calculates the absolute angular position of the load, based on the idealized dynamic model of the device, from the sensor signal of the gyroscope sensor.

With the regulation in accordance with the invention, it can be advantageous to use a control algorithm, in which the time functions for the desired position, the desired speed, the desired acceleration, the desired jerk and the derivation of the desired jerk is formed in a so-called path planning module. These functions are fed to the crane system in a pre-control block, weighted in such a manner that the resulting overall system of crane dynamics and pre-control is correct as to speed, acceleration, jerk and the derivation of the jerk. In this model, the cable length and the load mass are taken into account as additional changeable parameters.

BRIEF DESCRIPTION OF THE DRAWINGS

Further details and advantages of the invention are explained in greater detail using a sample embodiment represented in the drawing. The following are shown.

DESCRIPTION OF THE PREFERRED EMBODIMENTS

Figure 1:
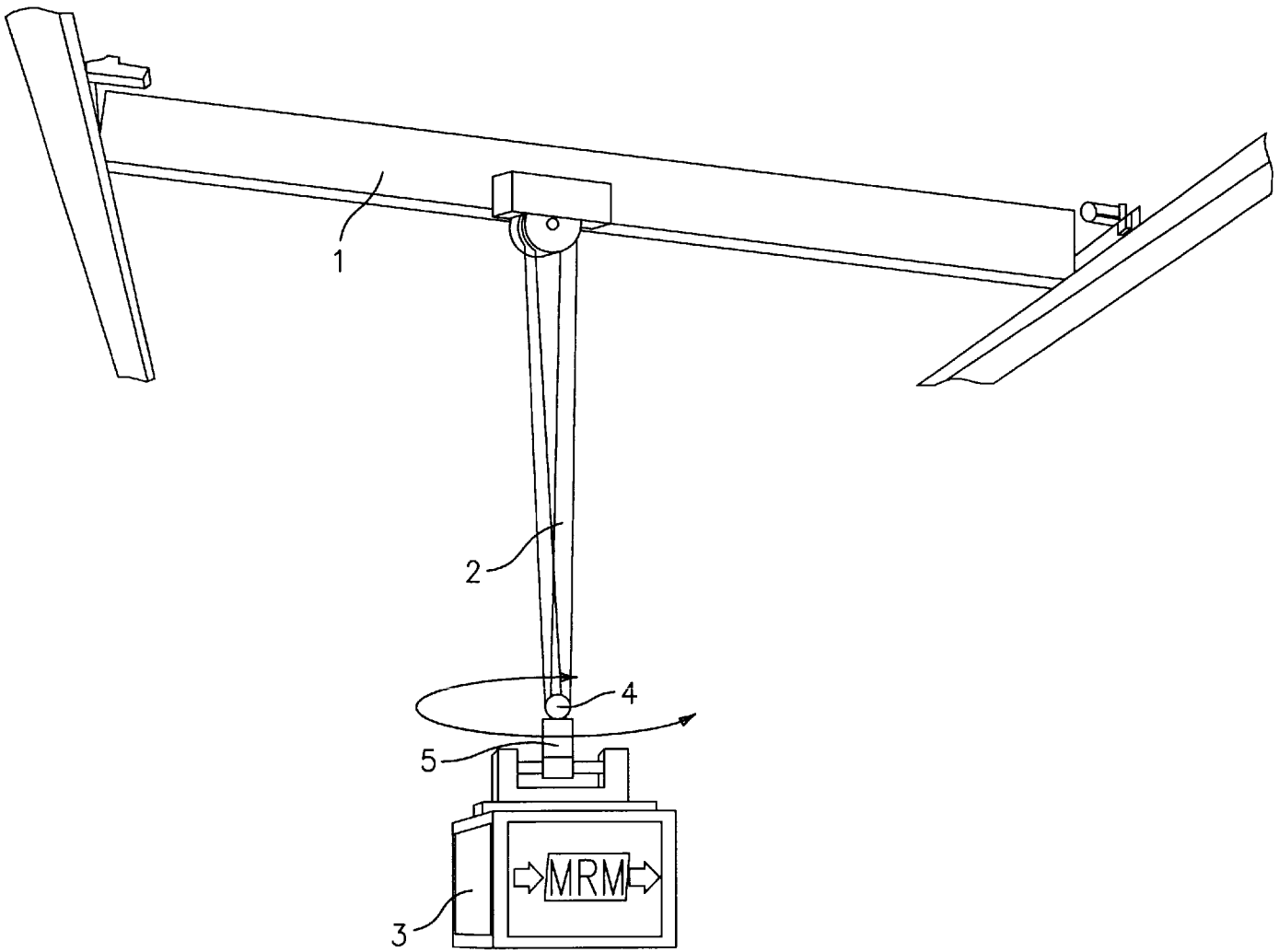
FIG. 1: the structure in principle of a crane with a load-lifting member

FIG. 1 shows the structure in principle of a crane 1 with a load-lifting member 3. Between the load-lifting member 3 and the lower flange 4 of the cable suspension 2 there is placed a rotating gear 5 around which the lower flange of the cable suspension can be rotated by motor with respect to the actual load-lifting member. Using this, the load can be rotated by the angle $\gamma$.

Figure 2:
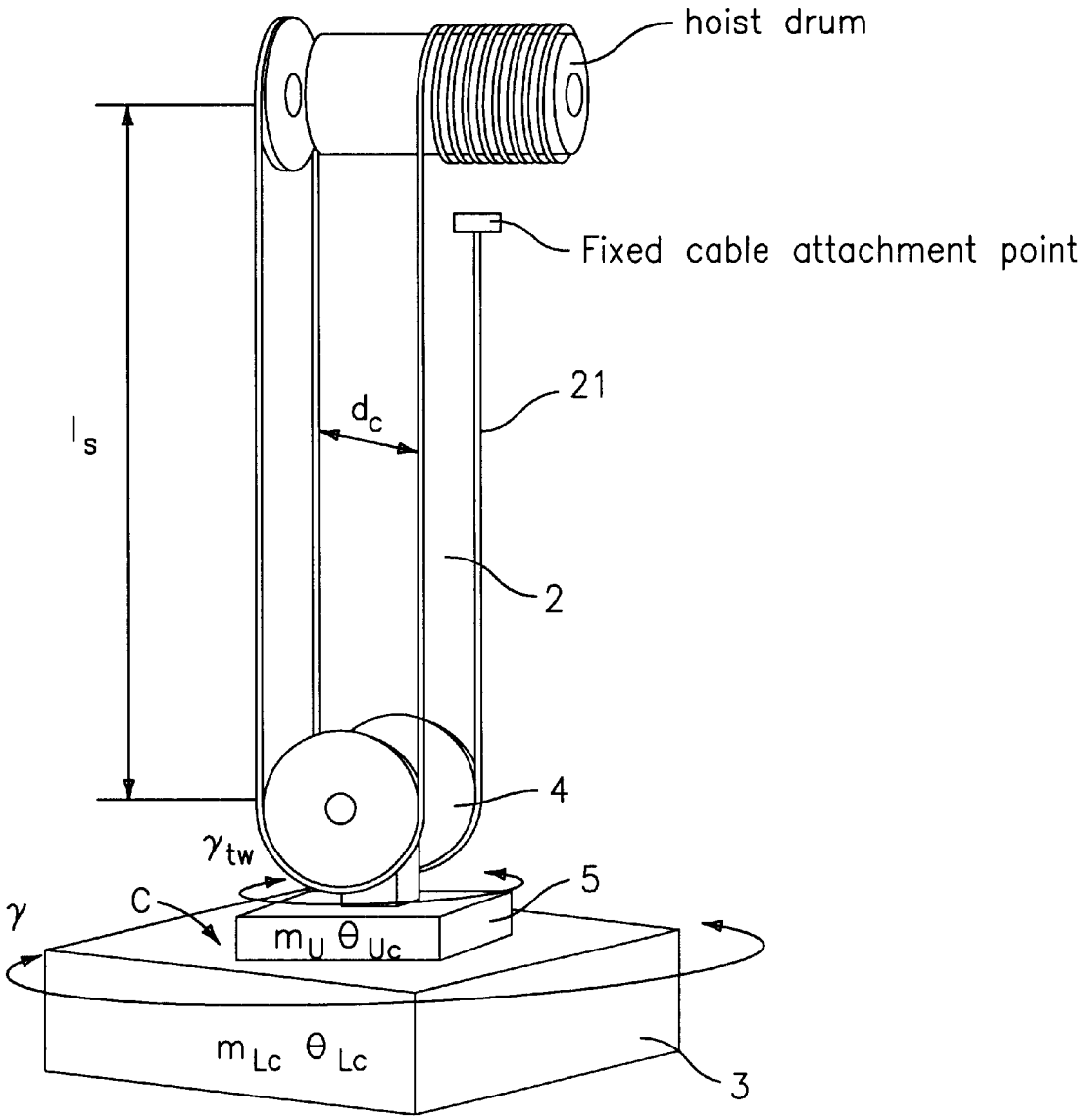
FIG. 2: the cable suspension of the control and rotating axis on the load-lifting member

On the basis of FIG. 2, a dynamic model is now derived to describe this process. The essential effect in the orientation of the load rests on the fact that, using the rotating gear, the lower flange 4 of the cable suspension 2 is rotated with respect to the load-lifting member 3. The position of the rotational axis corresponds to the variable c. The four bearing cables 21 twist counter to the direction of rotation of the turning axis. The twisting corresponds to the differential angle $$\gamma_{drill}=\gamma-c \tag{1}$$

This results in a slight lifting of the load. The diagonal distance of the bearing cables from each other is $d_e$. As a result of the twisting, the bearing cables are turned by the angle $\phi_{1drill}$.

$$\varphi_{1drill}=\frac{d_c\gamma_{drill}}{2l_S} \tag{2}$$

$l_S$ corresponds here to the length of the bearing cable 21 between the lifting cable drum and the lower block 4.

As a result, the load is raised by $$\Delta_{Z_{drill}}=l_S(1-\cos\phi_{1drill}) \tag{3}$$

[drill=twisting]

As a result, there arises a torque in the opposite direction of $$M_{drill}=F_{drill}\frac{d_c}{2} \quad \text{(unnumbered)}$$

with the accelerating force $$F_{drill}=m_L g\sin\phi_{1drill} \tag{4},$$

where $m_L$ is the mass of the load.

The torque $M_{drill}$ is converted into a rotary movement in the opposite direction. The result is a torsional oscillation that is described by the following differential equation.

$$(\Theta_{Lc}+\Theta_{Uc})\gamma_{drill}=-M_{drill}-M_c \tag{5}$$

$\Theta_{LC}$ is the moment of inertia in the rotation of the effector around the rotational axis, $\Theta_{UC}$ is the moment of inertia in the rotation of the lower block around the rotational axis, $M_C$ is the reaction to the driving torque of the drive of the rotational axis on the twisting angle $\gamma_{drill}$. As a function of the acceleration of the rotational axis, the driving moment is $$M_c=\Theta_{Lc}\ddot{c} \tag{6}$$

Equation 4 now becomes linear, since sine$\approx\phi\Theta_{1drill}$. From this, the following movement equation is obtained:

$$(\Theta_{Le}+\Theta_{Uc})\ddot{\gamma}_{drill}=-\frac{d_c^2 m_L g}{4\cdot l_S}\gamma_{drill}-\Theta_{Lc}\ddot{c} \tag{7}$$

In order to design a regulator that suppresses torsional oscillations that necessarily arise when the load is turned, differential equation 7 is converted to the actual spatial representation. As actual values, the angle of twisting the angular position of the rotational axis as well as its derivations are defined. This provides the following actual spatial model:

$$\dot{\underline{x}}_c=\underline{A}_c\underline{x}_c+\underline{B}_c\underline{u}_c$$

$$\underline{y}_c=\underline{C}_c\underline{x}_c$$

$$\underline{y}_{mc}=\underline{C}_{mc}\underline{x}_c \tag{8}$$

with actual vector:

$$x_c=\begin{bmatrix}\gamma drill\\ c\\ \dot{\gamma}drill\\ \dot{c}\end{bmatrix} \quad \text{(unnumbered)}$$

Input matrix:

$$\underline{B}_c=\begin{bmatrix}0\\0\\-\dfrac{\Theta_{Lc}}{\Theta_{Lc}+\Theta_{Uc}}\\1\end{bmatrix} \quad \text{(unnumbered)}$$

System matrix:

$$\underline{A}_c=\begin{bmatrix}0 & 0 & 1 & 0\\ 0 & 0 & 0 & 1\\ -\dfrac{d_c^2 m_L g}{4\cdot l_S(\Theta_{Lc}+\Theta_{Uc})} & 0 & 0 & 0\\ 0 & 0 & 0 & 0\end{bmatrix} \quad \text{(unnumbered)}$$

Input vector:

$$\underline{u}_c=\ddot{c}=\ddot{c}_{soll} \quad \text{(unnumbered)}$$

Output matrix of the regulating value:

$$\underline{C}_c=[1\ 1\ 0\ 0] \quad \text{(unnumbered)}$$

Output vector of the regulating value:

$$\underline{y}_c=\gamma \quad \text{(unnumbered)}$$

Output matrix of the measured value:

$$\underline{C}_{mc}=\begin{bmatrix}0 & 1 & 0 & 0\\ 0 & 0 & 1 & 1\end{bmatrix} \quad \text{(unnumbered)}$$

Output vector of the measured values:

$$\underline{y}_c=\begin{bmatrix}c\\ \dot{\gamma}\end{bmatrix} \tag{9}$$

The dynamics of the drive unit of the rotating axis is ignored. Thus, the acceleration of the rotational axis can be used as the input vector of the system, instead of the desired acceleration of the rotational axis. The input vector of the system description is, at the same time, the output value of the regulator derived below.

As measured values, the absolute angular rotational speed and the angular position of the rotational axis are available. The angular rotational speed is determined with a gyroscopic sensor. Since its measured value is made inaccurate due to drift and offset, a disturbance monitor must support the measured data evaluation. The position of the rotational axis is detected with an absolute encoder. The rotational angular speed of the rotational axis is determined through real differentiation.

For the following design of a pre-control and actual condition regulation, the model representation according to equations 8 and 9 is extended by bringing in the directional vector $\underline{W}_c$, through the pre-control matrix $\underline{S}_C$ and the actual feedback through the regulating matrix $\underline{K}_c$. From this we obtain $$\underline{u}_c=\underline{S}_c\cdot\underline{w}_c-\underline{K}_c\cdot\underline{x}_c \tag{10}$$

where drive value vector:

$$\underline{w}_c=\begin{bmatrix}\gamma_{Lref}\\ \dot{\gamma}_{Lref}\\ \ddot{\gamma}_{Lref}\\ \dddot{\gamma}_{Lref}\\ \gamma_{Lref}^{(IV)}\end{bmatrix} \quad \text{(unnumbered)}$$

Pre-control matrix:

$$\underline{S}_c=[K_{Vc0}K_{Vc1}K_{Vc2}K_{Vc3}K_{Vc4}] \tag{11}$$

Regulator matrix:

$$\underline{K}_c=[k_{c1}k_{c2}k_{c3}k_{c4}] \quad \text{(unnumbered)}$$

where $$\ddot{c}_{soll,rück}=-\underline{K}_c\underline{x}_c \text{ und } \ddot{c}_{soll,vors}\underline{S}_c\underline{w}_c \quad \text{(unnumbered)}$$

Figure 3:
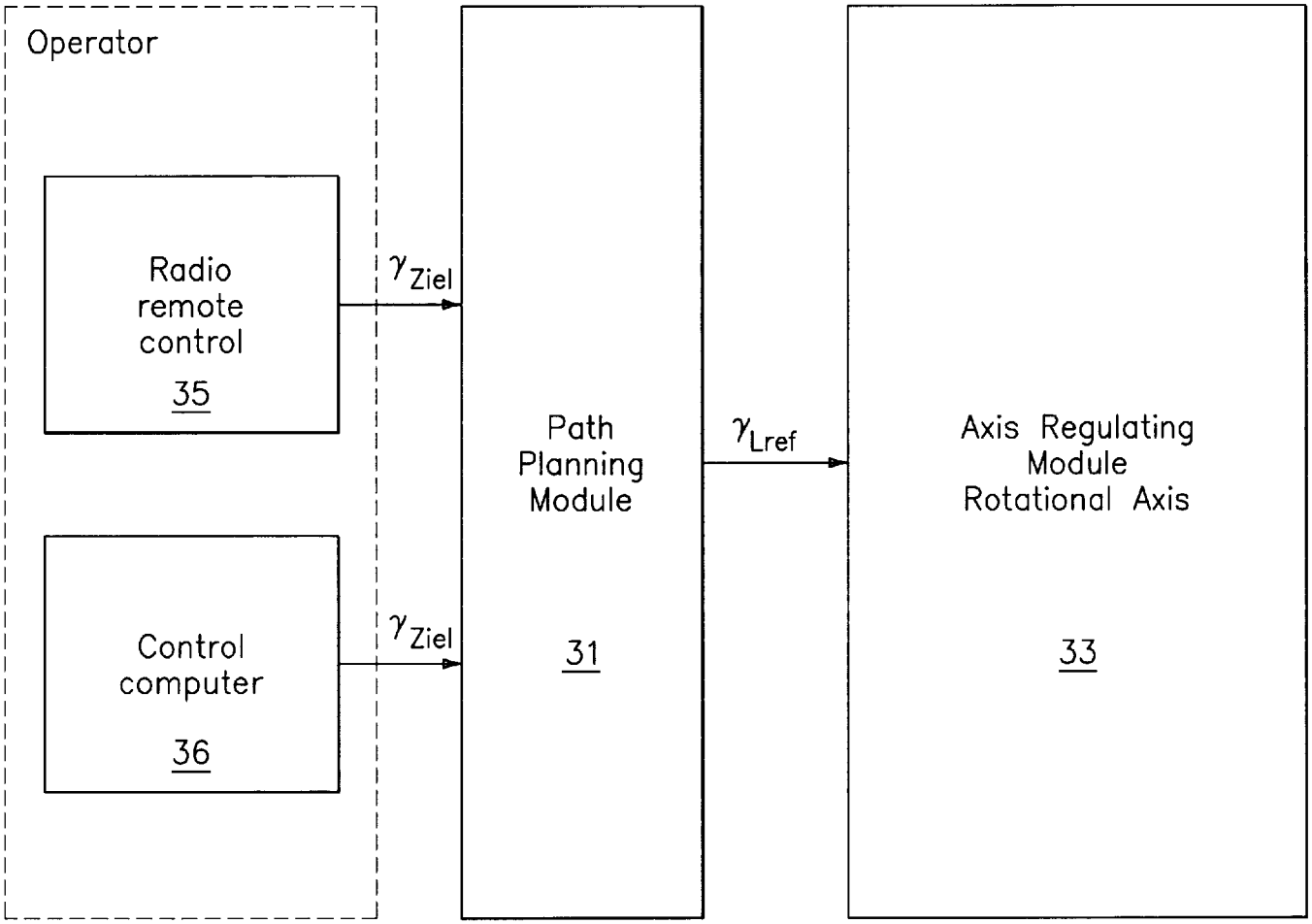
FIG. 3: the overall structure of the control
Figure 4:
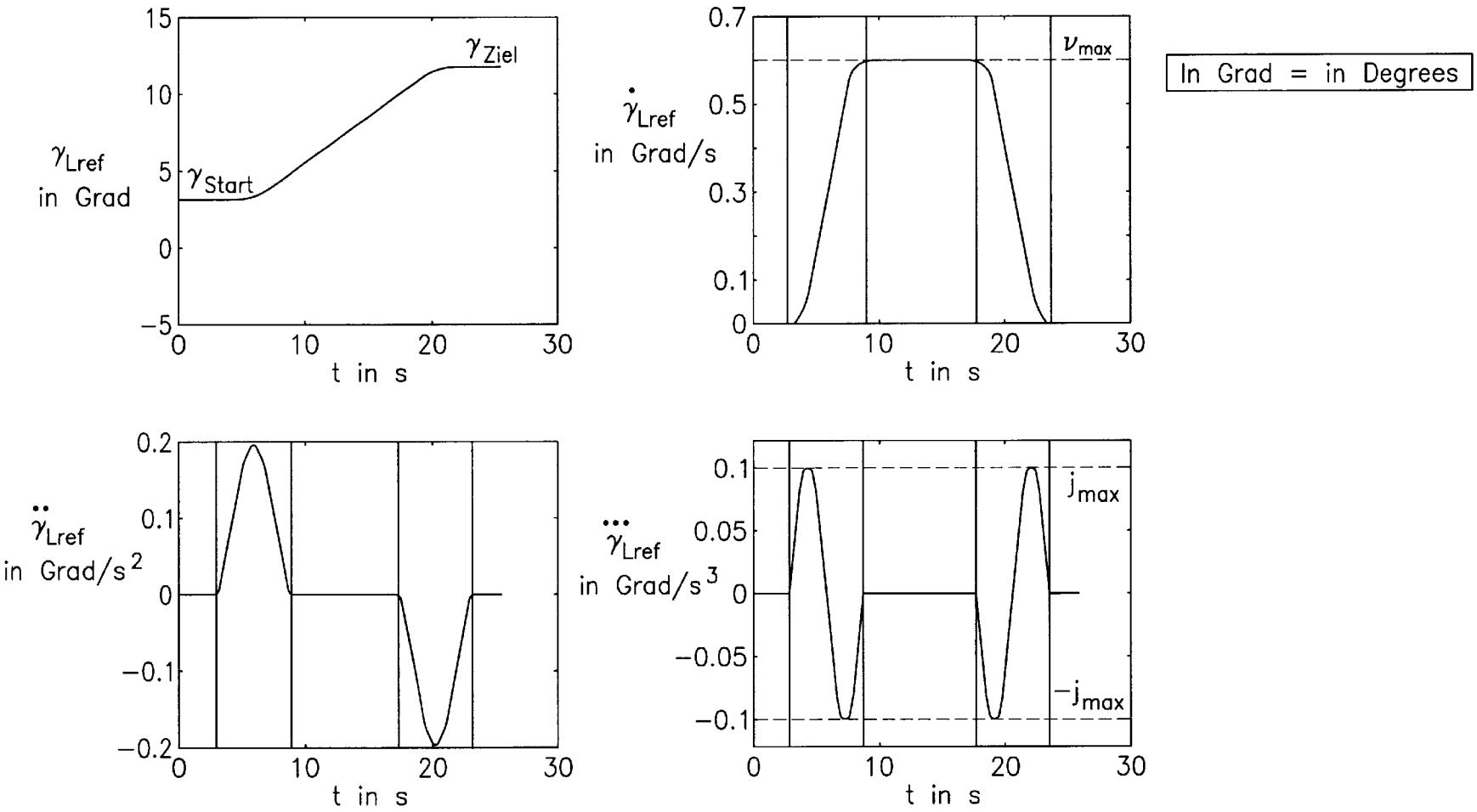
FIG. 4: examples of time functions of the path-planning module

In summary, the following overall structure of the control of the rotational axis can be represented (FIG. 3). The operator prescribes a goal position $\gamma_{goal}$, for example through the control computer 36 or a goal speed $\gamma'_{goal}$, for example through the wireless remote control 35. In the path planning module 31, the reference time functions for the desired positions $\gamma_{Lref}$, the desired speed $\gamma'_{Lref}$, the desired acceleration $\gamma''_{ref}$, the desired jerk $\gamma'''_{Lref}$ and the derivation of the desired jerk $\gamma^{(IV)}_{Lref}$, are calculated, where the kinematic calculations such as the maximum speed $v_{max}$, the maximum acceleration $\alpha_{max}$ and the maximum jerk $j'_{max}$ are always maintained. In FIG. 4, reference time functions generated as an example, as they has already been explained, for a similar system in DE 199 20 431.4 are represented. The reference time functions are the output values of the path planning module 31 and, at the same time, the input values for the axis regulator module 33, whose structure is represented in greater detail in FIG. 5.

[Translator's note: the "prime" character is used instead of the dots over the letters, for example, γ', γ", c". See original for actual symbols.]

The axis regulator module consists of the pre-control module 51, the condition regulator module 53 and the interference monitoring module 55. Input values are the reference time functions from the path planning module. The output function is the desired acceleration of the rotational axis c"soll. The necessary measured values are the cable length $l_s$, the load mass $m_L$, the position of the rotational axis c and the absolute angular speed of the load-lifting member γ'.

In the following, only the modules 51, 53 and 55 will be described in greater detail.

The actual conditions regulator 53 for the rotational axis is derived using the pole loading process. The characteristic equation of the system with the condition regulator is $$det(\underline{s}\underline{I}-\underline{A}_c+\underline{B}_c\cdot\underline{K}_c)=0 \tag{12}$$

The desired dynamics of the system regulated is determined using the polynomial $$P_c(s)=\prod_{i=1}^{4}(s-r_{ci})=s^4+p_{c3}s^3+p_{c2}s^2+p_{c1}s+p_{c0} \tag{13}$$

The $r_{ci}$'s are to chosen in such a manner that the system is stable, the regulation works sufficiently rapidly with good damping and the adjustment value limitations are not reached in the case of regulation deviations that typically occur. If equations 12 and 13 are set equal to each other, then the regulator amplifications $k_{c1}$ to $k_{c4}$ are determined at:

$$k_{c1}=\frac{4\cdot l_S p_{c0}(\Theta_{Lc}+\Theta_{Uc})^2}{\Theta_{Lc}d_c^2m_Lg}+\frac{m_Lgd_c^2}{4\cdot l_S\Theta_{Lc}}-p_{c2}\left(1+\frac{\Theta_{Uc}}{\Theta_{Lc}}\right) \tag{14}$$

$$k_{c2}=\frac{4\cdot l_S p_{c0}(\Theta_{Lc}+\Theta_{Uc})}{d_c^2m_Lg}$$

$$k_{c3}=\frac{4\cdot l_S p_{c1}(\Theta_{Lc}+\Theta_{Uc})^2}{\Theta_{Lc}d_c^2m_Lg}-p_{c3}\left(1+\frac{\Theta_{Uc}}{\Theta_{Lc}}\right)$$

$$k_{c4}=\frac{4\cdot l_S p_{c1}(\Theta_{Lc}+\Theta_{Uc})}{d_c^2m_Lg}$$

Figure 6:
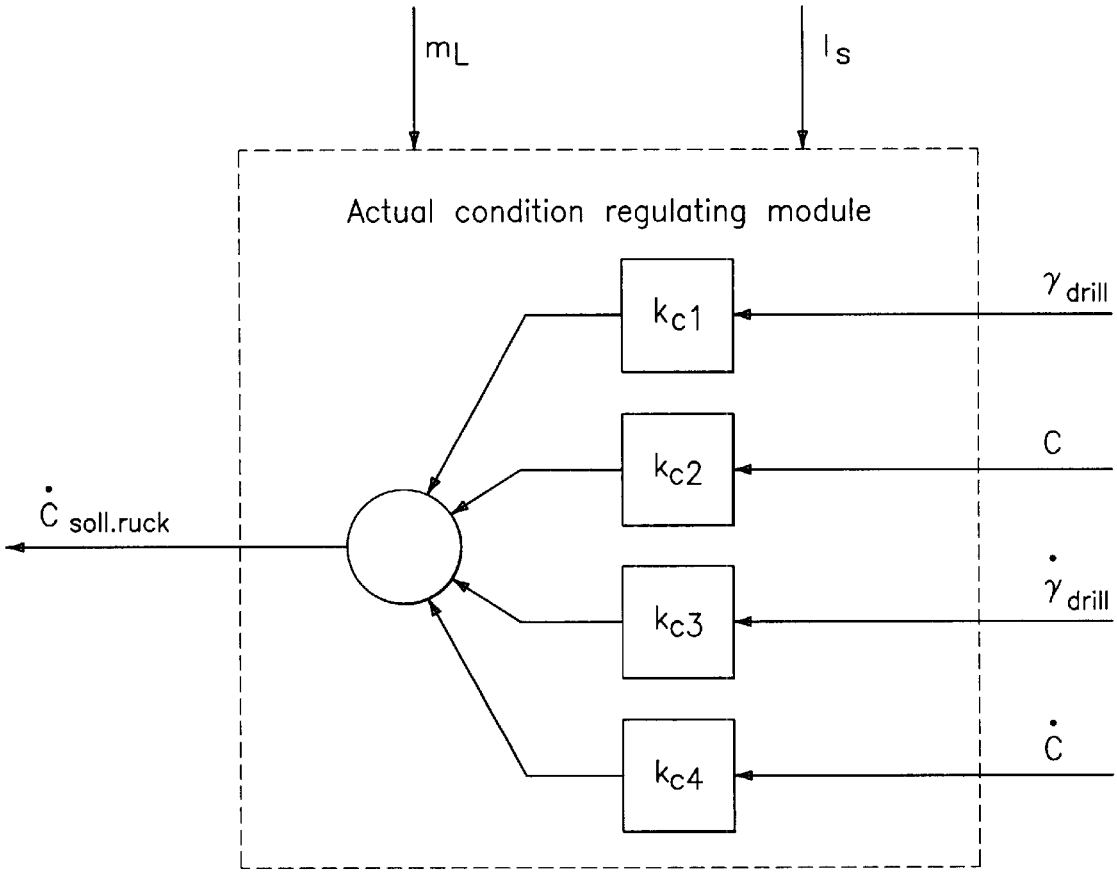
FIG. 6: the structure of the condition regulator

Dependent system parameters in the regulator amplifications $k_{c1}$ to $k_{c4}$ are the variables of the load mass $m_L$, the diagonal distance of the lifting cable $d_C$, the cable length $l_s$, the moment of inertia $\Theta_{LC}$ when rotating about the vertical axis for the load-lifting member, and the lower block $\Theta_{UC}$. Of these, the values $m_L$, $l_S$, $\Theta_{LC}$ are variable. The cable length $l_S$ and the load mass $m_L$ are present as measured values. Therefore, the moment of inertia $\Theta_{LC}$ can be determined from the load mass $m_L$, using the geometric dimensions of the cage box, assuming homogeneous mass distribution, as an approximation. As a result, therefore, the moment of inertia can also be attributed to the change in the load mass. The changing parameters in the adaptive later application of the regulator amplifications are therefore the load mass $m_L$, and the cable length $l_s$. The structure of the actual condition regulator module is again represented in FIG. 6. The actual values of the twist angle $\gamma_{drill}$ and its derivation, which is determined from the rotational speed γ' and the position of the rotational axis c, as well as the position of the rotational axis c itself and its derivation, are attributed through the regulator amplifications $k_{c1}$ to $k_{c4}$ to the setting input. The portion of the setting values, which is determined by the attribution, is designated as $c''_{soll\text{-}rück}$.

In the following, only the design of the pre-control module 51 will be shown. The path planning module 31 generates the reference time functions $\gamma_{Lref}$ of the desired angle position, angle speed, acceleration and jerk for the orientation γ of the load in the working space. These are interpreted for the rotational axis as control value vectors $\underline{w}_c$, which are fed to the input $\underline{u}_c$ through the pre-control matrix $\underline{S}_C$.

First, the transmission function $$G(s)=\frac{\gamma}{\ddot{c}_{soll,\,vorst}}=\underline{C}_c\cdot(s\underline{I}-\underline{A}_c+\underline{B}_c\underline{K}_c)^{-1}\underline{B}_c \tag{15}$$

is derived. The evaluation of equation 15 leads to a transmission function with a denominator degree corresponding to the system arrangement of n=4.

$$G(s)=\frac{(4\,l_S\Theta_U s^2+d_c^2m_Lg)}{\begin{array}{l}4\,l_S(\Theta_{Lc}+\Theta_U)s^4+4\,l_S(k_{c4}(\Theta_{Lc}+\Theta_U)-k_{c3}\Theta_{Lc})s^3+(4\,l_S\Theta_{Lc}(k_{c2}-k_{c1})+\\(4\,l_S\Theta_U k_{c2}+d_c^2m_Lg)s^2+k_{c4}d_c^2m_Lg\cdot s+k_{c2}d_c^2m_Lg\end{array}} \tag{16}$$

On the basis of the denominator degree 4 of equation 16, an upward progression of up to grade 4 is to be provided for. For the pre-control itself, therefore, after evaluation of equations 10 and 11 and the transformation into the frequency range, the following transmission ratio results.

$$G_{vorst}=\frac{\ddot{c}_{soll,\,vorst}}{\gamma Lref}=(K_{Vc0}+K_{Vc1}s+K_{Vc2}s^2+K_{Vc3}s^3+K_{Vc4}s^4) \tag{17}$$

As a result, one receives the following transmission function:

$$G_{ges}(s)=G_{vorst}(s)\cdot G(s)=\frac{\ldots b_2(K_{Vci})\cdot s^2+b_1(K_{Vci})\cdot s+b_0(K_{Vci})}{\ldots a_2\cdot s^2+a_1\cdot s+a_0} \tag{18}$$

To calculate the amplifications $K_{V0}$ to $K_{V4}$ on the basis of degree 4 of the denominator polynomial in equation 16, only the coefficients $b_4$ through $b_0$ and $a_4$ through $a_0$ are of interest. An ideal system behavior with respect to position, speed, acceleration, jerk and possibly the derivation of the jerk results precisely in the case that the transmission function of the total system of pre-control and transmission function satisfies in its coefficients $b_i$ and $a_i$ the following conditions:

$$\frac{b_0}{a_0}=1 \quad \frac{b_1}{a_1}=1 \quad \frac{b_2}{a_2}=1 \quad \frac{b_3}{a_3}=1 \quad \frac{b_4}{a_4}=1 \tag{19}$$

After evaluation analogous to equations 7–17, the following pre-control amplifications are obtained:

$$\begin{aligned} K_{Vc0} &= k_{c2} \\ K_{Vc1} &= k_{c4} \\ K_{Vc2} &= \frac{4\cdot l_S\Theta_{Lc}(k_{c1}-k_{c2})}{d_c^2 m_L g}-1 \\ K_{Vc3} &= \frac{4\cdot l_S\Theta_{Lc}(k_{c3}-k_{c4})}{d_c^2 m_L g} \\ K_{Vc4} &= \frac{4\cdot l_S\Theta_{Lc}}{d_c^2 m_L g}+\frac{16\cdot l_S^2\cdot\Theta_{Lc}\Theta_{Uc}(k_{c1}-k_{c2})}{(d_c^2 m_L g)^2} \end{aligned} \tag{20}$$

Figure 7:
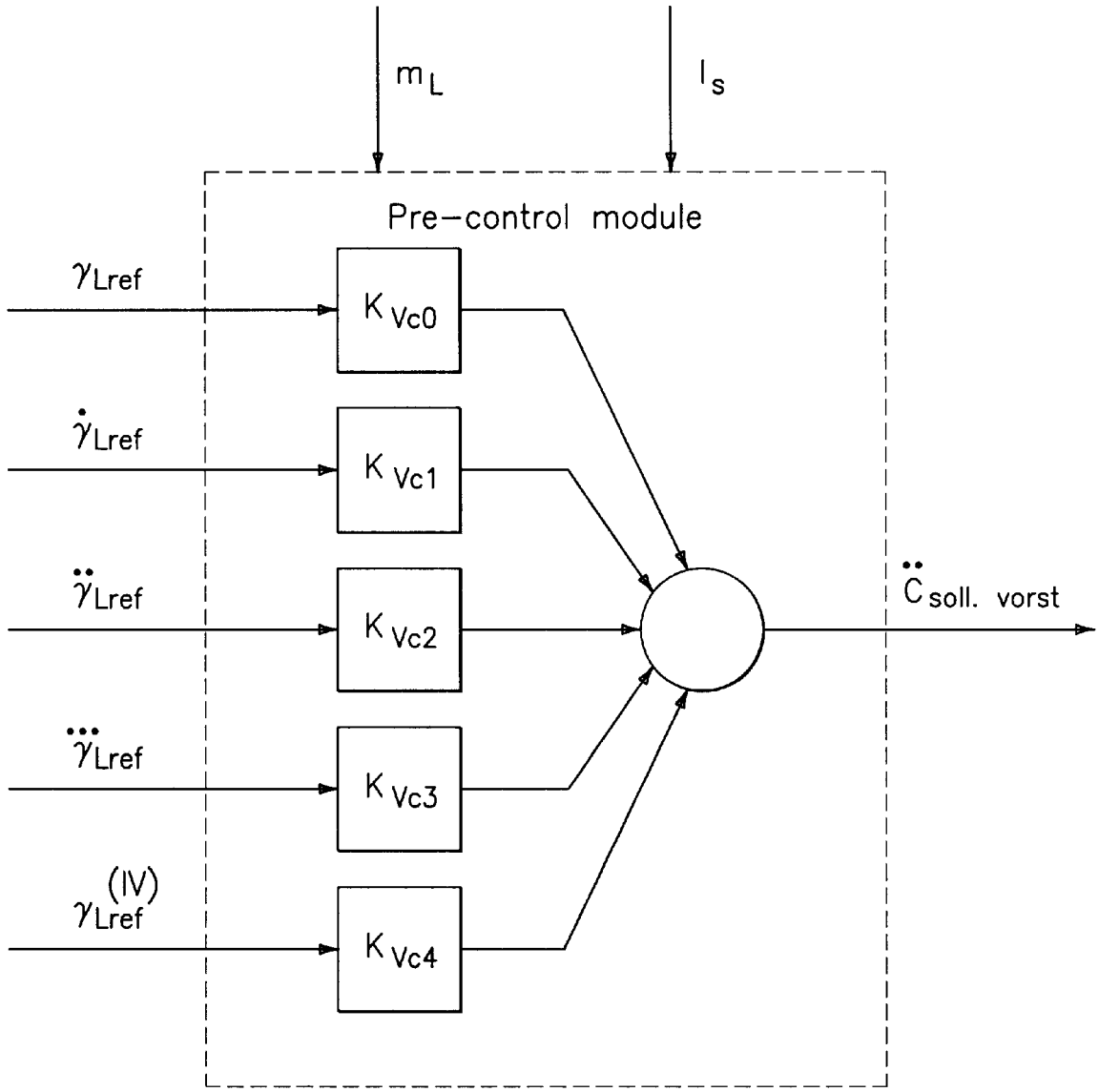
FIG. 7: the structure of the pre-control

The expressions according to equation 20 show that, for the adaptive post-control of the amplifications, the system parameters $m_L$, $d_c$, $l_S$ $\Theta_{Lc}$, and $\Theta_{Uc}$ must be taken into account in the pre-control. As in the case of the actual conditions regulation module, a homogeneous mass distribution is assumed and the moment of inertia $\Theta_{Lc}$ is estimated from the load mass and the geometrical measurements of the cage box. The changeable parameters in the adaptive post-after control are therefore the load mass $m_L$ and the cable length $l_S$. The structure of the pre-control is represented in FIG. 7. Input data are the reference time functions from the path planning module, the output value is the portion of pre-control $c''_{soll,vorst}$ in the setting value $c''_{soll}$.

To measure the absolute angular speed of the load, a gyroscopic sensor is installed on the load-lifting member. The measurement signal of the sensor is overlaid with a substantial offset, due to the measuring principle. The offset in the measuring signal causes positional errors in regulation during orientation of the load. Therefore, the offset is estimated and compensated for in an interference monitor. For this purpose, the offset error $\gamma_{Offset}$, is input as an interference value. The interference is assumed to be constant by sections. The interference model is, therefore, $$\gamma_{Offset}=0 \tag{21}$$

The actual condition spatial representation of the partial model for the rotating axis according to equations 8 and 9 is supplemented by the interference model. In the present case, a complete monitor is deduced. The monitor equation for the modified actual condition spatial model is therefore:

$$\dot{\underline{x}}_{cz}+(\underline{A}_{cz}-\underline{H}_{cz}\underline{C}_{mcz})\cdot\underline{x}_{cz}+\underline{B}_{cz}\cdot\underline{u}_c+\underline{H}_{cz}\underline{y}_{mc} \tag{22}$$

where, as a supplement to equation 9, the following matrices and vectors are introduced.

Actual condition vector:

$$\underline{x}_{cz}=\begin{bmatrix}\gamma drill\\ c\\ \dot{\gamma} drill\\ \dot{c}\\ \dot{\gamma} offset\end{bmatrix} \quad \text{(unnumbered)}$$

Input matrix:

$$\underline{B}_{cz}=\begin{bmatrix}0\\0\\-\dfrac{\Theta_{Lc}}{\Theta_{Lc}+\Theta_{Uc}}\\1\\0\end{bmatrix} \quad \text{(unnumbered)}$$

System matrix:

$$\underline{A}_{cz}=\begin{bmatrix}0&0&1&0&0\\0&0&0&1&0\\A_{cz31}&0&0&0&0\\0&0&0&0&0\\0&0&0&0&0\end{bmatrix} \quad \text{(unnumbered)}$$

$$A_{cz31}=\frac{m_L g d_g^2}{4\,l_S(\Theta_{Lc}+\Theta_{Uc})}$$

Interference monitor matrix:

$$\underline{H}_{cz}=\begin{bmatrix}h_{11c}&h_{12c}\\h_{21c}&h_{22c}\\h_{31c}&h_{32c}\\h_{41c}&h_{42c}\\h_{51c}&h_{52c}\end{bmatrix} \quad \text{(unnumbered)}$$

Monitor output matrix:

$$\underline{C}_{mcz}=\begin{bmatrix}0&1&0&0&0\\0&0&1&1&1\end{bmatrix} \tag{23}$$

For the design of the monitor, the system in transformed according to equation 23 into the monitor normal form. The monitor is designed in monitor normal form through pole loading and then the system is again transformed back. In this connection, the poles $r_{cz1.2}$ and $r_{cz3,4}$ are chosen with a multiplicity of two and the pole $r_{cz5}$ with a multiplicity of one. The interference monitor matrix for the interference monitor 55 is then $$\underline{H}_{cz}=\begin{bmatrix}0 & 1-\dfrac{4\,l_S\Theta_{Lc}^2(2\,r_{cz3,4}r_{cz5}+r_{cz3,4}^2)}{m_L g d_g^2}\\ -2r_{cz1,2} & 0\\ 0 & \dfrac{4\,l_S\Theta_{Lc}^2 r_{cz5}r_{cz3,4}^2}{m_L g d_g^2}-2r_{cz3,4}-r_{cz5}\\ r_{cz1,2}^2 & 0\\ -r_{cz1,2}^2 & -\dfrac{4\,l_S\Theta_L^2 r_{cz5}r_{cz3,4}^2}{m_L g d_g^2}\end{bmatrix} \tag{24}$$

Figure 8:
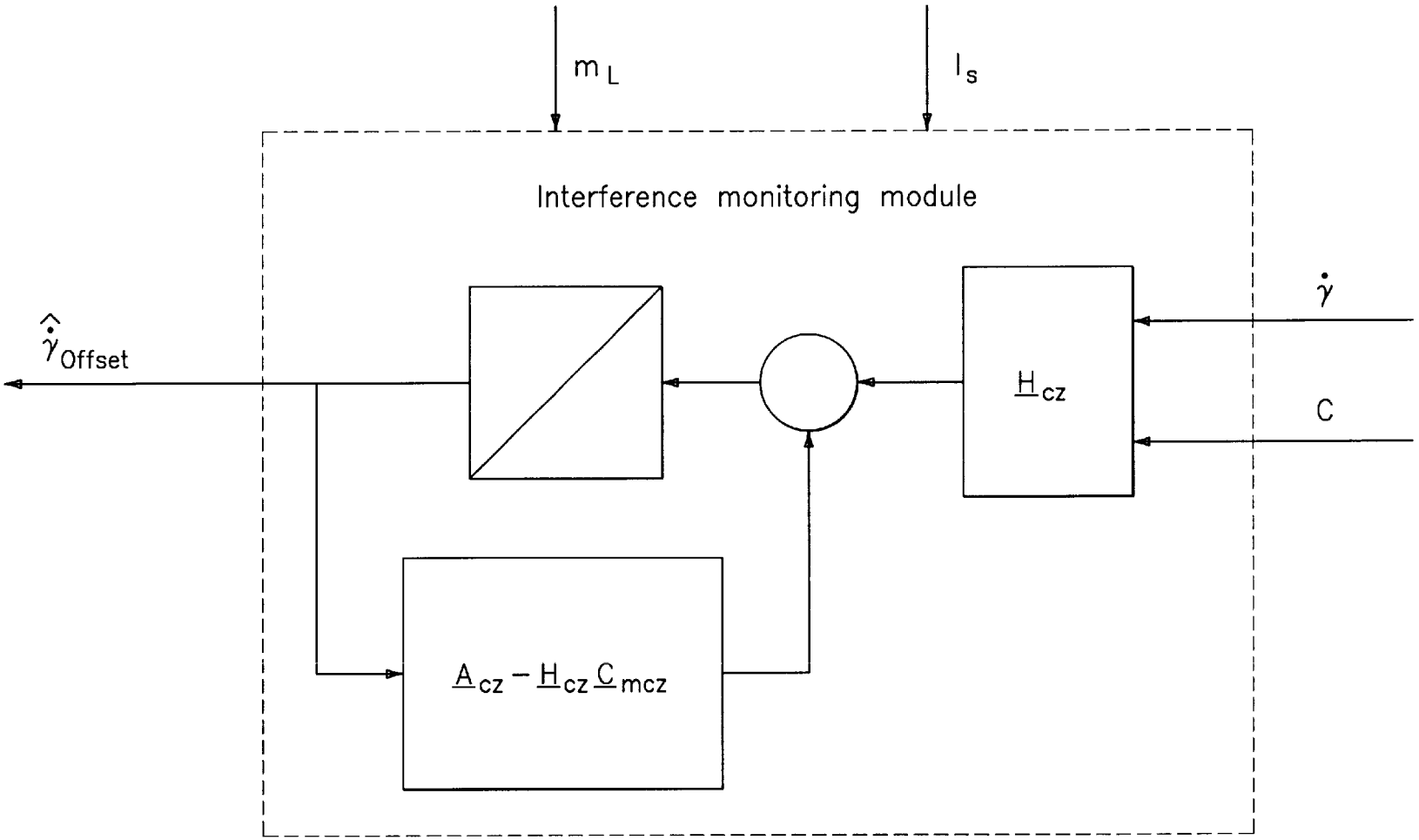
FIG. 8: the structure of the interference monitor

With the representation according to equation 24, there is then an analytical expression dependent upon the system parameters $m_L$, $d_g$, $l_S$, $\Theta_{LC}$. In order to adapt the interference monitor 55, the measured values $m_L$ and $l_S$ are necessary. The structure of the interference monitor 55 is represented in FIG. 8.

From the measured values of the position of the rotational axis c and the rotational speed γ' of the load-lifting member, the interference monitor is used to determine the offset error $\gamma'_{offset}$. In this manner, it is possible to correct the measured value of the rotational speed $\gamma'$ and therefore to calculate the twisting angle $\gamma'_{drill}$ reliably for the actual condition regulator.

Figure 5:
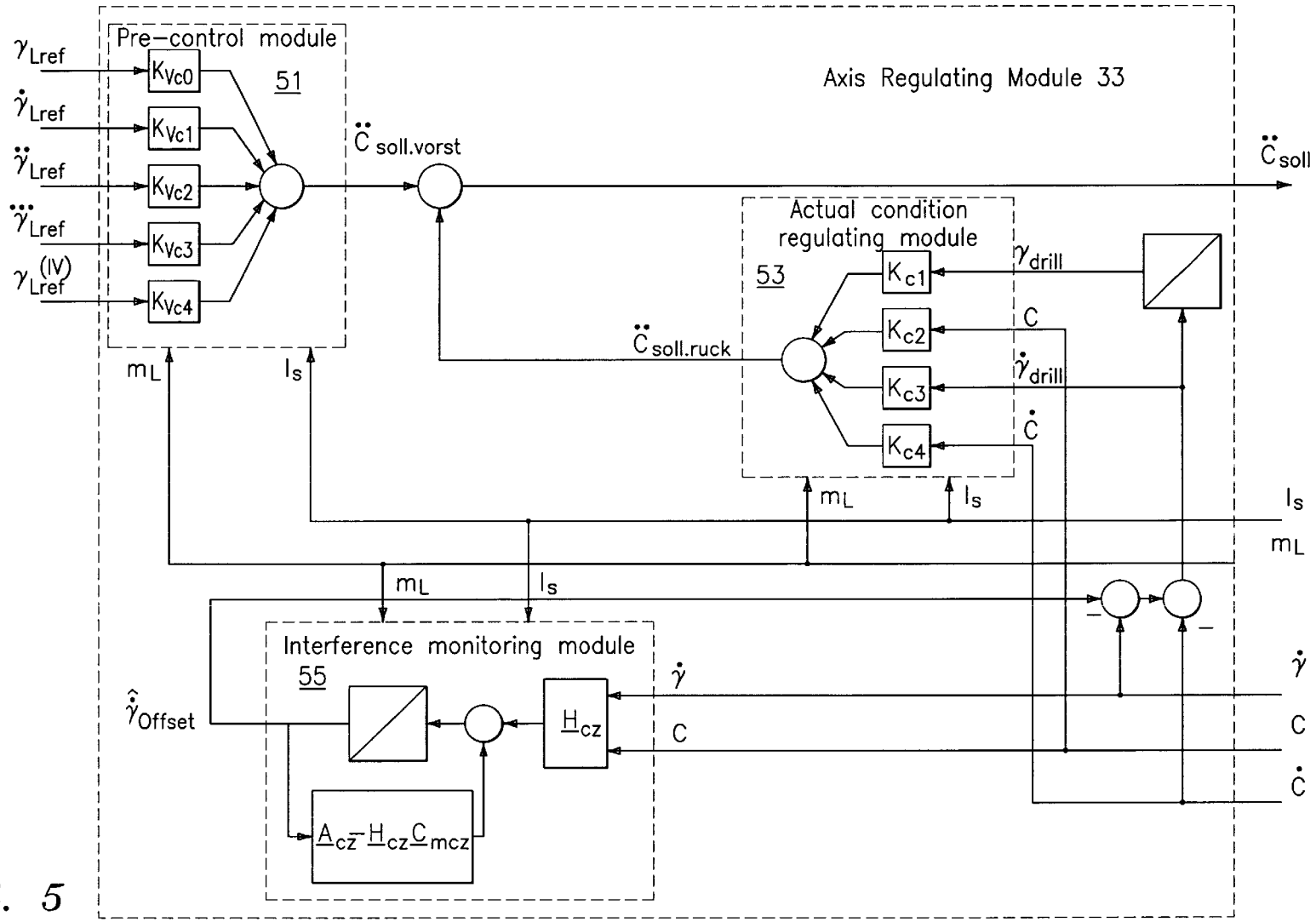
FIG. 5: the structure of the axis regulator

Since in the above the individual partial modules 51, 53 and 55 were introduced, the total structure should now again be shown on the basis of FIG. 5, in order to clarify again the relationships between the partial modules. FIG. 5 shows the structure of the axis regulator module for the rotational axis of the load-lifting member. Input values for the pre-control module 51 are the reference time functions $\gamma_{t.ref}$ of the path planning module 31. On the basis of the system order n=4, an upward move can be made up to the derivation of the desired jerk. The output value is $c''_{soll.vorst}$. Using the actual condition regulator 53, the actual condition values $\gamma$, $\gamma'$, c, c' are fed back to the input as $c''_{soll.rük}$. As measured values, the position of the rotational axis c as well as its speed c' formed through actual differentiation and the rotational speed $\gamma'$ corrected for offset are present. For compensation of the offset error in the gyroscopic signal, there is therefore introduced an interference monitoring module 55, which estimates the offset $\gamma'_{offset}$ Thereafter, the measurement signal of the gyroscope sensor is corrected by this estimated offset before it is fed to the actual condition regulation and before it is integrated for the derivation of the position signal $\gamma$. This is why the interference monitor 55 is absolutely necessary in this case for the function of the actual condition regulating module 53. The output value of the axis regulating module is the desired acceleration of the rotational axis $c''_{soll}$.

What is claimed is:

1. Method for orienting load (3) on a crane (1), comprising the steps of supporting the load (3) on the crane (1) by cables (2), turning the load (3) by a specified absolute angle ($\gamma$) by rotating a gear (5) positioned between the cables (2) and load (3), and suppressing torsional oscillations of the load (3) by regulating the rotating gear (5), including measuring absolute rotational angular speed ($\gamma'$) and angular position (c) of the rotating gear (5) and feeding these measurements back to a setting input as input values.

2. Method in accordance with claim 1, wherein regulating the rotating gear (5) comprises the additional step of positioning the load (3) to a preset desired rotational angle ($\gamma_{Lref}$).

3. Method according to claim 2, comprising the additional step of measuring the absolute rotational angular speed ($\gamma'$) with a gyroscopic sensor.

4. Method in accordance with claim 2, comprising the additional steps of measuring cable length ($I_s$) and load mass ($m_L$) in a path planning module (31), computing time functions for at least one of desired angle position ($\gamma_{Lref}$), angular speed ($\gamma'_{Lref}$), angular acceleration ($\gamma''_{Lref}$), angle jerk ($\gamma'''_{Lref}$) and derivation of jerk ($\gamma^{iv}_{Lref}$) for orientation ($\gamma$) of load (3) in a working space, and weighting the thus-computed values in a pre-control block (51) of an axis regulating module (33) with pre-control amplification ($K_{v1}$) such that coefficients of a resulting transfer function, through crane dynamics and pre-control of form $$G_{ges}(S) = G_{vorst}(S) \cdot G(S) = \frac{\ldots\ b_2(Kv_{ci}) \cdot s^2 + b_1(Kv_{ci}) \cdot s + b_0(Kv_{ci})}{\ldots\ a_2 s^2 + a_1 s + a_0}$$

comply with the following conditions $$\frac{b_0}{a_0} = 1 \quad \frac{b_1}{a_1} = 1 \quad \frac{b_2}{a_2} = 1 \quad \frac{b_3}{a_3} = 1 \quad \frac{b_4}{a_4} = 1.$$

5. Method in accordance with claim 2, comprising the step of calculating control amplifications determined by a transmission function, as a function of load mass ($m_L$) and cable length ($I_s$).

6. Method in accordance with claim 2, comprising the additional step of generating, in a path planning module (31), time functions of desired position ($\gamma_{Lref}$), speed ($\gamma'_{Lref}$), acceleration ($\gamma''_{Lref}$) and jerk ($\gamma'''_{Lref}$), considering kinematic limitations.

7. Method in accordance with claim 2, comprising the additional step of correcting an offset arising in a measuring signal of the gyroscopic sensor in an interference monitoring module (55) based upon estimation and compensation for the offset error.

8. Method in accordance with claim 1, comprising the additional step of measuring the absolute rotational angular speed ($\gamma'$) with a gyroscopic sensor.

9. Method in accordance with claim 8, comprising the additional step of correcting an offset arising in a measuring signal of the gyroscopic sensor in an interference monitoring module (55) based upon estimation and compensation for the offset error.

10. Method in accordance with claim 9, comprising the additional steps of measuring cable length ($I_s$) and load mass ($m_L$) in a path planning module (31), computing time functions for at least one of desired angle position ($\gamma_{Lref}$), angular speed ($\gamma'_{Lref}$), angular acceleration ($\gamma''_{Lref}$), angle jerk ($\gamma'''_{Lref}$) and derivation of jerk ($\gamma^{iv}_{Lref}$) for orientation ($\gamma$) of load (3) in a working space, and weighting the thus-computed values in a pre-control block (51) of an axis regulating module (33) with pre-control amplification ($K_{v1}$) such that coefficients of a resulting transfer function, through crane dynamics and pre-control of form $$G_{ges}(S) = G_{vorst}(S) \cdot G(S) = \frac{\ldots\ b_2(Kv_{ci}) \cdot s^2 + b_1(Kv_{ci}) \cdot s + b_0(Kv_{ci})}{\ldots\ a_2 s^2 + a_1 s + a_0}$$

comply with the following conditions $$\frac{b_0}{a_0} = 1 \quad \frac{b_1}{a_1} = 1 \quad \frac{b_2}{a_2} = 1 \quad \frac{b_3}{a_3} = 1 \quad \frac{b_4}{a_4} = 1.$$

11. Method in accordance with claim 8, comprising the additional step of calculating control amplifications determined by a transmission function, as a function of load mass ($m_L$) and cable length ($I_s$).

12. Method in accordance with claim 8, comprising the additional step of generating, in a path planning module (31), time functions of desired position ($\gamma_{Lref}$), speed ($\gamma'_{Lref}$), acceleration ($\gamma''_{Lref}$) and jerk ($\gamma'''_{Lref}$), considering kinematic limitations.

13. Method in accordance with claim 1, comprising the additional steps of measuring cable length ($I_s$) and load mass ($m_L$) in a path planning module (31), computing time functions for at least one of desired angle position ($\gamma_{Lref}$), angular speed ($\gamma'_{Lref}$), angular acceleration ($\gamma''_{Lref}$), angle jerk ($\gamma'''_{Lref}$) and derivation of jerk ($\gamma^{iv}_{Lref}$) for orientation ($\gamma$) of load (3) in a working space, and weighting the thus-computed values in a pre-control block (51) of an axis regulating module (33) with pre-control amplification ($K_{v1}$) such that coefficients of a resulting transfer function, through crane dynamics and pre-control of form $$G_{ges}(S) = G_{vorsr}(S) \cdot G(S) = \frac{\ldots\ b_2(Kv_{ci}) \cdot s^2 + b_1(Kv_{ci}) \cdot s + b_0(Kv_{ci})}{\ldots\ a_2 s^2 + a_1 s + a_0}$$

comply with the following conditions $$\frac{b_0}{a_0} = 1 \quad \frac{b_1}{a_1} = 1 \quad \frac{b_2}{a_2} = 1 \quad \frac{b_3}{a_3} = 1 \quad \frac{b_4}{a_4} = 1.$$

14. Method in accordance with claim 13, comprising the additional step of calculating control amplifications determined by a transmission function, as a mass ($m_L$) and cable length ($I_s$).

15. Method in accordance with claim 13, comprising the additional step of generating, in a path planning module (31), time functions of desired position ($\gamma_{Lref}$), speed ($\gamma'_{Lref}$), acceleration ($\gamma''_{Lref}$) and jerk ($\gamma'''_{Lref}$), considering kinematic limitations.

16. Method in accordance with claim 13, comprising the additional step of correcting an offset arising in a measuring signal of a gyroscopic sensor in an interference monitoring module (55) based upon estimation and compensation for the offset error.

17. Method in accordance with claim 1, comprising the additional step of calculating control amplifications determined by a transmission function, as a function of load mass ($m_L$) and cable length ($I_s$).

18. Method in accordance with claim 1, comprising the additional step of generating, in a path planning module (31), time functions of desired position ($\gamma_{Lref}$), speed ($\gamma'_{Lref}$), acceleration ($\gamma''_{Lref}$) and jerk ($\gamma'''_{Lref}$), considering kinematic limitations.

19. Method in accordance with claim 18, comprising the additional step of generating in path planning module (31), time function for derivation of desired jerk ($\gamma^{IV}_{Lref}$).

20. Method in accordance with claim 1, comprising the additional step of correcting an offset arising in a measuring signal of the gyroscopic sensor in an interference monitoring module (55) based upon estimation and compensation for the offset error.

* * * * *